US010217554B2

(12) United States Patent
Thode et al.

(10) Patent No.: US 10,217,554 B2
(45) Date of Patent: Feb. 26, 2019

(54) BISTABLE ELECTROMAGNETIC ACTUATOR DEVICE

(71) Applicant: ETO Magnetic GmbH, Stockach (DE)

(72) Inventors: Oliver Thode, Stockach (DE); Joerg Buerssner, Engen (DE)

(73) Assignee: ETO Magnetic GmbH, Stockach (DE)

( * ) Notice: Subject to any disclaimer, the term of this patent is extended or adjusted under 35 U.S.C. 154(b) by 0 days.

(21) Appl. No.: 15/510,787

(22) PCT Filed: Sep. 17, 2015

(86) PCT No.: PCT/EP2015/071348
§ 371 (c)(1),
(2) Date: Mar. 13, 2017

(87) PCT Pub. No.: WO2016/042088
PCT Pub. Date: Mar. 24, 2016

(65) Prior Publication Data

US 2017/0256348 A1 Sep. 7, 2017

(30) Foreign Application Priority Data

Sep. 18, 2014 (DE) ..... 10 2014 113 500

(51) Int. Cl.
*H01F 7/122* (2006.01)
*H01F 7/16* (2006.01)
*H01F 7/18* (2006.01)

(52) U.S. Cl.
CPC ..... *H01F 7/122* (2013.01); *H01F 7/1607* (2013.01); *H01F 7/1615* (2013.01);
(Continued)

(58) Field of Classification Search
CPC ..... H01H 51/22; H01H 75/00; H01F 7/22; H01F 7/1607; H01F 7/145; H01F 7/00
(Continued)

(56) References Cited

U.S. PATENT DOCUMENTS 4,859,975 A * 8/1989 Uetsuhara ..... H01F 7/1615 335/230
5,140,210 A * 8/1992 Shirakawa ..... H02K 1/278 310/156.28
(Continued)

FOREIGN PATENT DOCUMENTS

DE 20114466 U1 1/2002
DE 202009006940 U1 9/2010
(Continued)

OTHER PUBLICATIONS

International search report for Application No. PCT/EP2015/071348 dated Jan. 7, 2016.
(Continued)

*Primary Examiner* — Shawki S Ismail
*Assistant Examiner* — Lisa Nhung Homza
(74) *Attorney, Agent, or Firm* — Bachman & LaPointe, PC

(57) ABSTRACT

A bistable electromagnetic actuator device, a permanent magnet means (12; 12*a*, 12*b*), as well as an armature unit (18) with an elongate plunger unit (10) extending along a moving direction, wherein said armature unit can be moved into at least one of two end and/or stop positions that are stable in the deenergized state by means of stationary electromagnetic driving means (22), wherein stationary magnetic field detector means (34; 34*a*, 34*b*) are assigned to a housing (20), which at least sectionally encloses the armature unit, for the contactless interaction with the permanent magnet means in at least one of the end or stop positions provided for the armature position detection, wherein the plunger unit features a terminal contact and/or engagement section (28) for interacting with an actuating partner in a contacting and non-positive fashion such that a non-positive contact and/or actuation by the actuating partner causes a motion of the armature unit into one of the end
(Continued)

or stop positions, in which the armature unit remains in a stable fashion in the deenergized state, when the electromagnetic driving means are deactivated, and wherein the magnetic field detector means are arranged and wired for generating and outputting a detector signal corresponding to this end or stop position.

11 Claims, 2 Drawing Sheets

(52) U.S. Cl.
CPC ... *H01F 7/1844* (2013.01); *H01F 2007/1669* (2013.01); *H01F 2007/1684* (2013.01); *H01F 2007/185* (2013.01)

(58) Field of Classification Search
USPC ..... 335/229
See application file for complete search history.

(56) References Cited

U.S. PATENT DOCUMENTS 5,546,063 A 8/1996 Hoffman
5,912,604 A * 6/1999 Harvey ..... H01H 33/6662 218/138
6,950,000 B1 * 9/2005 Lanni ..... H01F 7/081 251/129.15
6,967,550 B2 11/2005 Elendt et al.
7,053,742 B2 * 5/2006 Lanni ..... H01F 7/081 335/220
8,448,615 B2 5/2013 Laufenberg et al.
8,476,996 B2 * 7/2013 Liang ..... H01H 51/2263 335/78
9,934,924 B2 * 4/2018 Liang ..... H01H 50/22
2002/0158727 A1 * 10/2002 Namen ..... E05B 47/00 335/78
2013/0192436 A1 * 8/2013 Barea ..... B65H 54/71 83/79

FOREIGN PATENT DOCUMENTS

DE 202010010371 U1 10/2011
DE 102012113056 A1 6/2014
EP 2587496 A1 5/2013

OTHER PUBLICATIONS

Chinese office action for Application No. 201580049995.3 dated Oct. 10, 2017.
Chinese office action for patent application No. 201580049995.3 dated Jul. 6, 2018.

* cited by examiner

BISTABLE ELECTROMAGNETIC ACTUATOR DEVICE

BACKGROUND OF THE INVENTION

The present invention relates to a bistable electromagnetic actuator device, as well as a utilization of such an actuator device.

Electromagnetic actuator devices are generally known from the prior art; for example, DE 201 14 466 U1 of the applicant discloses a bistable electromagnetic actuator device that features an armature unit with permanent magnet means, as well as an elongate plunger unit extending along a moving direction. This permanent-magnetic armature unit is driven by means of stationary electromagnetic driving means in the form of a stationary core unit, to which a suitably energizable coil unit is assigned. This arrangement is enclosed by a magnetically conductive housing that closes the magnetic circuit required for the motion.

The end of the plunger unit forms a contact or engagement section for an actuating partner, which in the generic prior art consists of an adjusting groove of an internal combustion engine designed for camshaft adjustments, wherein said contact and/or engagement section is particularly suitable for transmitting a driving force, which is generated by energizing the driving means, and a resulting motion of the armature unit to the actuating partner.

This type of technology, which represents the generic prior art, has not only gained acceptance in the technical field of camshaft adjustments in internal combustion engines, wherein the popularity of known devices is not only based on high duty cycle numbers and long service lives, but particularly also an automated manufacturability.

It is also known from the prior art to assign suitable sensor means to an electromagnetically operated actuating device, wherein said sensor means particularly register or detect an intended advance of the plunger unit and thereby allow an (e.g. electronically evaluable) functionality check of the actuator system. For example, an incomplete or faulty plunger motion would initially be suitably detected and the complete, correct motion (e.g. extension) of the plunger unit would subsequently be realized with a corresponding control functionality, in which a sensor signal is utilized.

Furthermore, various position and motion detection sensors in the form of generic technologies are known from the prior art. These sensors are used in virtually all relevant applications of the industrial and private technology and provide a suitable basis for control and feedback control functionalities, e.g. in accordance with the above-discussed technology and the respective field of application.

However, a motion detection or position detection of an actuating partner is particularly difficult if a reliable and failsafe detection has to be realized in connection with a not always clearly defined initial position or starting position of the actuating partner to be monitored with respect to its motion or position, for example, within a limited structural space or under particularly stressful ambient conditions such as moisture, vibrations or heat (e.g. in the generic field of motor vehicles). In this case, it was traditionally required to initially determine an initial position or starting position of the actuating partner in a first step and to then detect the motion of the actuating partner from this determined initial position or starting position in a subsequent monitoring step. The costs for the required technical equipment are correspondingly high and additionally increased due to the above-discussed problematic ambient conditions, e.g., in the present exemplary field of application of motor vehicle technology.

SUMMARY OF THE INVENTION

The present invention is therefore based on the objective of making available a device that is suitable for detecting a position and/or motion of an actuating partner and not only allows a positive detection and signal output, in particular, under the above-discussed problematic ambient conditions, but in fact also makes it possible to reliably establish an initial detection state even if an electric signal or a power supply is not permanently available or applied. The objective of the invention insofar also concerns establishing a stable functionality in the (temporarily) deenergized state.

This objective is attained by means of the bistable electromagnetic actuator device with the characteristics disclosed herein; advantageous enhancements of the invention are also described herein. The present invention furthermore claims protection for a utilization of an inventive bistable electromagnetic actuator device as a motion sensor and/or position sensor for the actuating partner engaging on the (at least one terminal) contact and/or engagement section of the actuator device, as well as for a system featuring an inventive actuator device and an actuating partner to be evaluated or monitored with respect to the position detection and/or motion detection.

The present invention is based on the realization that the inventively modified electromagnetic actuating device of the initially discussed type is advantageously not only suitable for actively causing an actuation of the actuating partner in response to the activation of the stationary driving means (typically an energization of coil means provided in this case), but can also act as a sensor, particularly even if the driving means are deenergized or deactivated: since the inventive magnetic field detector means provided for suitably interacting with the permanent magnet means of the armature unit can—also independently of the electromagnetic drive—be evaluated with respect to the current position or motion of the plunger unit carrying the permanent magnet means, a modular functionality for stressful environments is therefore achieved within the inventive housing, which is already suitable for environments stressed by moisture, temperatures and/or vibrations anyway; in this context, the magnetic field detector means additionally and synergistically not only allow continuous permanent monitoring of the motion of the plunger unit (and therefore the contact with or the actuation by the actuating partner to be detected), but the driving means assigned to the plunger unit also make it possible to position the plunger unit in the desired fashion, e.g., in order to establish an initial detection state and therefore a defined sensor position or detection position. Consequently, this technology is also superior to known approaches in that it basically allows a detection of the plunger unit by monitoring a coil signal of the driving means in a deenergized or deactivated state; this type of induction-based signaling particularly would only act in a signal-generating fashion when a motion of the armature unit relative to the coil unit takes place, wherein this is in turn only possible in a deenergized state of the coil. This makes such an approach unsuitable for the position detection, particularly also in a stationary or non-moving state of the armature unit.

According to the present invention, the functionality of a known bistable electromagnetic actuator device is therefore significantly increased, namely in that it is basically used as a position sensor and the motion functionality inherent to the actuator device—directly or indirectly by coupling—is used for establishing a desired or intended sensor (starting) position. The invention therefore is suitable for any detection tasks with respect to the actuating partner, wherein an "actuating partner" in the context of the present invention does not necessarily have to refer to the adjustment of this unit by the actuator system, but an inventive "actuating partner" may in fact also refer to any partner, body or similar unit that mechanically and inventively interacts with the plunger unit in a contacting or actuating fashion in order to thereby act upon the plunger unit and accordingly can be used as basis for the inventive sensor system.

In the context of the present invention, it is preferred to design the inventive stationary electromagnetic driving means in the form of an assembly that is integrated into the surrounding housing and usually realized by means of a stationary coil/core functionality because the beneficial closed, modular effect is thereby advantageously achieved and the device is particularly suitable for being manufactured in series. However, the invention is basically not limited to such an integrated solution, but in fact also includes embodiments, in which the stationary electromagnetic driving means forms an isolated (and basically independent) assembly to be realized, e.g., by means of an otherwise known electromagnetic actuator system and in which said assembly acts upon the plunger unit opposite to the terminal contact or engagement section approximately along the elongate plunger unit.

The invention advantageously and synergistically proposes to utilize the permanent magnet means, which are provided for the electromagnetic drive of the armature unit anyway and preferably realized in the form of radially widened bodies referred to the elongate plunger unit or (a) radially widened disk(s) (particularly in a radially symmetric context of a realization about a symmetry axis extending along the moving direction): this permanent-magnetic field is very suitable for generating a reliable detection signal, particularly also under the stressful ambient conditions cited in the problem definition, in that the magnetic field detector means—which according to an enhancement typically operate on the basis of semiconductors and are realized, e.g., in the form of Hall sensors or alternatively by means of coils—are provided at the desired detector positions on or in the housing and thereby effectively cooperate in the detection. It is furthermore advantageous that this detection is possible in any mechanical and electrical operating state of the actuator device and, in particular, can also take place independently of an energization state of the electromagnetic driving means.

According to preferred enhancements of the invention, the inventive bistability may be realized in different ways. If the invention is realized with permanent magnet means comprising only one permanent magnet body (such as a permanent magnet disk seated on the plunger unit), for example, it is advantageous to form a stopping face on one end and to thereby establish a first end or stop position on the driving means (typically on a stationary core section), wherein additional mechanical disks or assemblies may then optionally and in accordance with a concrete embodiment be provided on the anchor side (i.e., assigned to the permanent magnet body) and/or the core side (e.g., similar to an anti-adhesion disk) in order to prevent damages to the (typically brittle) permanent magnet material during the stopping process and/or to ensure a magnetic minimum clearance at the stop. If only this one permanent magnet body is provided, a second, opposite end or stop position in the moving path of the armature could be realized in the form of a housing face section of the housing, which in a suitable magnetic design would adhesively interact with the permanent magnet body in order to establish the bistable deenergized state (on the core side, the permanent magnet body would likewise adhere to the core).

In contrast to this mechanically simple inventive embodiment realized with only one permanent magnet body, a preferred variation of the invention, in which (at least) two permanent magnet bodies form the permanent magnet means, has the advantage that two end or stop positions of the armature unit can be realized along its moving path by means of the core unit (with assigned stationary coil unit) forming the driving means without requiring a (stable deenergized) stop on the respective end in the housing. According to an enhancement of this variation, the elongate plunger unit would particularly be realized in such a way that—guided approximately within the stationary core unit—it extends out of both ends of this core unit, wherein the (preferably disk-like) permanent magnet bodies of the permanent magnet means are respectively formed on the plunger unit on both ends in order to adhesively interact with a core end face. In this case, these permanent magnet bodies are spaced apart from one another on the plunger unit in such a way that only one permanent magnet disk respectively is (adhesively) in contact with the core unit (more precisely: a respective outer surface of the core unit facing the permanent magnet disk) in accordance with a positional or motional state of the armature unit relative to the stationary core unit (with attached coil unit) whereas a clearance between the core unit and the permanent magnet disk exists on the respective axially opposite end of the core unit. In order to insofar realize the interaction with the actuating partner with virtually arbitrary flexibility, the open housing end (respectively referred to the axial direction) may be virtually designed arbitrarily on both ends and accordingly feature suitable mechanical interface means for interacting with the (at least one) actuating partner; this particular embodiment also makes it possible to detect actuating partners or their moving and positioning behavior axially on both ends in a particularly sophisticated fashion.

In advantageous enhancements of the invention, it is not only possible to utilize different sensor and detector principles for detecting the permanent magnetic field of the permanent magnet means in the above-described fashion, but these (individual) detectors or sensors (or a plurality thereof) can also be provided at virtually arbitrary positions on or in the housing such that the moving path of the plunger unit during an actuation by the actuating partner particularly can also be divided into a plurality of sections and correspondingly tracked or monitored by the detectors. According to the invention, such a detector not only can be provided at arbitrary positions on or in the housing, but enhancements of the invention also propose to ensure the required magnetic field communication between the permanent magnet means (guided in the interior of the housing that typically is magnetically conductive) and the detector(s) by providing the housing with apertures, openings, non-conductive material inserts or similar measures at the detector position(s).

Arbitrary variations and embodiments may be considered for the concrete mechanical design of the contact and/or engagement section of the plunger unit, which basically may also be realized on both ends (see above). For example, conventional coupling and connecting technologies such as screw connections, latch connections, catch connections or similar measures may be considered for producing a non-positive connection with the actuating partner, which can be subjected to tension and/or pressure, wherein suitable contact and engagement sections in the form of grooves, undercuts or the like also simplify the non-positive actuations in both axial directions. However, the invention likewise proposes that the plunger is actuated by the actuating partner via a non-positive connection that is only effective in one direction (e.g. in a direction of pressure). In such instances, a planar or suitably designed contact or end face of the plunger unit basically suffices for the interaction with the actuating partner, wherein a probe head of sorts in the form of a contouring (e.g. with conical or dome-shaped design) may be realized in this case in accordance with another enhancement in order to not only detect axially exerted actuating forces, but also actuations that act at an angle to the axial direction.

According to another enhancement of the invention, it is proposed that the moving behavior and therefore the detection behavior of the armature unit in response to the contact or actuation by the actuating partner is influenced by providing spring means as a potential energy accumulator. Spring means of this type, which are according to this enhancement preferably realized, e.g., in the form of a flat coil spring and/or a pressure spring arranged concentric to the plunger unit in the housing and particularly supported on the permanent magnet means, have the advantage that a simple mechanical adaptability to different detector conditions can be realized in accordance with a known or predefined energy accumulator effect or force path effect and in dependence on the positioning and moving behavior requirements of the actuating partner.

As a result, the present invention makes it possible to utilize an electromagnetic actuator device as a position detector and/or motion detector for an actuating partner acting upon the plunger unit in a surprisingly simple, sophisticated and advantageous fashion with respect to its manufacture, wherein the modular advantages or manufacturing technology advantages of the actuator device can be additionally utilized. The additional costs are furthermore limited to suitably providing the stationary magnetic field detector means on or in the housing. Consequently, the present invention is suitable for any applications in the private and industrial technology, wherein the above-discussed stressful ambient conditions, e.g. in a motor vehicle environment, are indeed preferred for a utilization of the invention, but this particular utilization does not exclusively define the scope of applications of the invention. The present invention should also not be interpreted strictly in terms of technical equipment, but in fact also concerns procedural aspects that can be gathered from the preceding disclosure and the following description of exemplary embodiments.

BRIEF DESCRIPTION OF THE DRAWINGS

Other advantages, characteristics and details of the invention result from the following description of preferred exemplary embodiments with reference to the figures; in these figures.

DETAILED DESCRIPTION

In the following description of exemplary embodiments, identical or identically acting functional components of the illustrated exemplary embodiments are identified by the same reference symbols.

Figure 1:
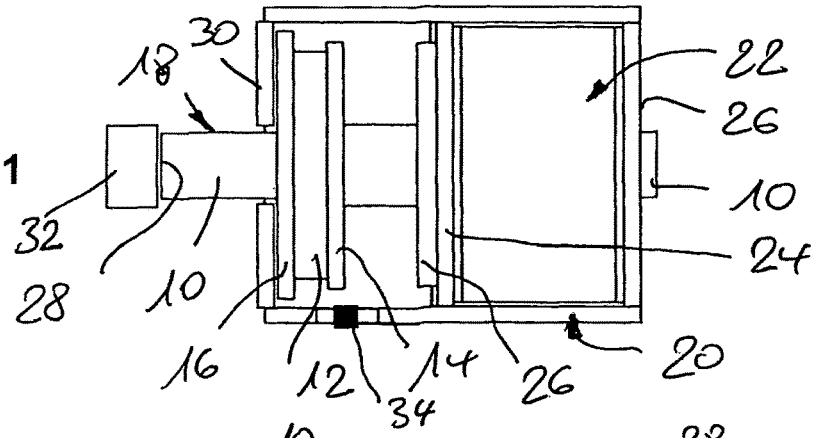
FIG. 1 shows a schematic longitudinal section through the bistable electromagnetic actuator device according to a first exemplary embodiment of the present invention, in which only one permanent magnet body forms the permanent magnet means.

The schematic longitudinal section through the bistable electromagnetic actuator device according to the first exemplary embodiment illustrated in FIG. 1 shows an elongate, axially extending plunger unit 10 (with "axial" in the context of the invention referring to an axis that extends along the moving direction and therefore transverse to the plane of projection of FIG. 1), wherein an (axially magnetized) permanent magnet disk 12 is seated on said plunger unit and bordered by (otherwise known) flux-conducting disks 14 and 16 on both ends. The thusly formed armature unit 18 is guided in a housing 20 such that it can be axially moved relative to electromagnetic driving means 22 in the form of a core unit 24 and a (not-shown) coil unit surrounding this core unit, wherein the stator core terminally forms a stationary stopping face 26 (in the form of an otherwise known anti-adhesion spacer disk) in the direction of the permanent magnet means 12.

The hollow-cylindrical housing 20 made of magnetically conductive sheet metal is respectively closed on its faces (in a magnetically conductive fashion), wherein a disk-shaped housing wall 26 provides an opening for an end of the plunger 10 on one end (the right end in FIG. 1) and a disk-shaped housing wall section 30 likewise provides a stop and a stable deenergized holding position for the armature unit (more precisely: the permanent magnet unit 12 with adjoining flux-conducting disks 14, 16) on the other end in the direction of an engagement end 28 of the plunger 10. FIG. 1 insofar elucidates a first of two stable deenergized end or stop positions of the armature unit relative to the driving means in the housing.

The device illustrated in FIG. 1 is configured for the detecting interaction with an actuating partner 32, which is merely illustrated schematically and can act upon the plunger unit 10 and therefore the armature unit 18 in order to exert a force of pressure (in the rightward direction in the plane of projection of FIG. 1). Accordingly, the engagement section 28 provided on the end of the plunger 10 consists of a planar, disk-shaped surface.

A magnetic detector element 34 is provided in the lower surface area of the housing 20 illustrated in FIG. 1, wherein said magnetic detector element is seated in a cutout in the housing shell (which is closed with a magnetically non-conductive material) and thereby can interact with the permanent magnetic field of the permanent magnet disk 12 in a detecting fashion. In this case, the Hall sensor 34 is realized and designed in such a way that a detection signal or position signal is generated in the stop position illustrated on the left side in FIG. 1 whereas a different sensor signal to be evaluated and then electronically processed by (not-shown) evaluation means is generated in the opposite stop position of the armature unit 18 (in this case, the permanent magnet unit 12 would adhere to the core 24 in a deenergized fashion and the disk 14 would accordingly rest on the outer surface 26).

The device illustrated in FIG. 1 operates as described below: when an actuating partner 32 exerts a force of pressure upon the armature unit 18 by means of the engagement face 28, e.g. due to a rightward motion along the axial direction in FIG. 1, the armature unit moves rightward from the end or stop position illustrated on the left side up to the stop on the core region as soon as the exerted force exceeds the permanent-magnetic adhesive force on the housing end face 30. In addition, a permanent-magnetic force of attraction acts between the permanent magnet disk 12 and the (stationary) core 24 as soon as a magnetic interaction takes place and thereby boosts the motion. The coil in the driving unit 22 is deenergized during this operation; the device acts as a position sensor or motion sensor for the actuating partner 32: as soon as the permanent magnet 12 leaves the effective detection range of the magnetic field sensor 24 as the actuation and therefore the motion of the armature unit continues, the signal of this detector changes such that the change in position caused by the actuating partner 32 is reliably detected and available for being evaluated.

In a subsequent state, in which the armature position relative to the housing may, if applicable, also be unclear or undefined (e.g., because an intermediate deenergized state does not allow an electronic position storage), an energization of the coil provided in the unit 22 would then conventionally cause the armature unit to once again move back into the extended (starting) position illustrated in FIG. 1 due to the repulsive effect on the permanent magnet unit 12. The actuator system, which is integrated into the housing 20 in this exemplary embodiment, therefore makes it possible to establish a defined armature position at any time, namely in that the position according to FIG. 1 is purposefully established in interaction with the actuating partner 32 by means of energization, if applicable, prior to carrying out the above-described detecting or measuring operation.

In this case, all processes and components are enclosed by the housing (which in the preferred embodiment is realized cylindrically and therefore configured radially symmetrical) as illustrated in the figure and correspondingly well protected against various types of environmental influences, e.g. moisture, temperatures, vibrations or the like, such that the invention is ideally suitable for correspondingly stressful operating environments.

Figure 2:
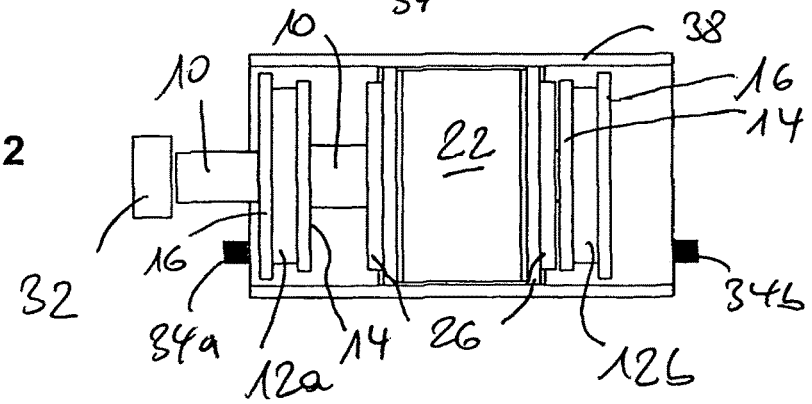
FIG. 2 and FIG. 3 respectively show a longitudinal section analogous to FIG. 1 through a second and preferred exemplary embodiment of the invention, in which the permanent magnet means are formed by two permanent magnet bodies arranged axially to both sides of the stationary electromagnetic driving means and FIGS. 2, 3 respectively show the end or stop positions.
Figure 3:
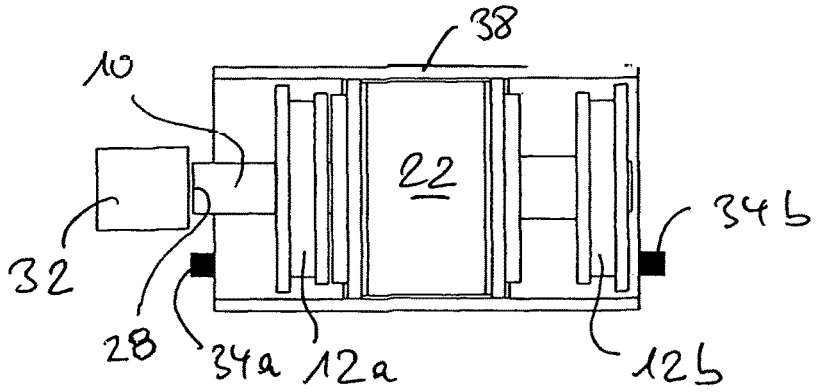

FIGS. 2 and 3 show an alternative variation of the exemplary embodiment according to FIG. 1, wherein the permanent magnet means in the exemplary embodiment according to FIGS. 2 and 3 are respectively realized in the form of a left permanent magnet unit 12*a* and a right permanent magnet unit 12*b* (referred to the plane of projection), i.e. to both sides of a centric stator unit that is once again realized in the form of a stationary core 26 and a (not-shown) coil means assigned thereto; the core now provides stopping faces 26 for interacting with the respective permanent magnet arrangement 12*a*, 12*b* axially on both sides, wherein the elongate plunger unit 10 connecting these permanent magnet disks 12*a*, 12*b* (with respectively assigned disks 14, 16) extends axially and centrally through the stationary driving unit 22 and is thusly guided thereby.

In the exemplary embodiment according to FIGS. 2, 3, FIG. 2 shows a first end or stop position, in which the right permanent magnet section 12*b* of the armature unit is (insofar deenergized and adhesively) in contact with the stationary core whereas FIG. 3 shows the opposite end or stop position; in this case, the permanent magnet unit 12*a* is in contact with the core 26 (with adjacent sides 16, 14) whereas the permanent magnet unit 12*b* maintains an axial clearance from the core. A comparison between FIG. 3 and FIG. 2 shows that this change in position in the form of a change-over of sorts once again takes place in the form of an actuation by the actuating partner 32 due to a horizontal (in the figures rightward) force application upon the planar engagement end 28 on the face of the plunger 10. It should be noted that a cylinder 38, which is open on both ends, is provided for the housing in the exemplary embodiment according to FIGS. 2, 3; in contrast to the first exemplary embodiment according to FIG. 1, a closing wall is neither required in the open housing region on the left side nor in the right open region. In fact, a centric, fixed (stationary) core region 22 exclusively defines both stop positions of the horizontally movable armature unit.

FIGS. 2, 3 schematically show a pair of Hall sensors 34*a*, 34*b* that respectively protrude into the open housing end regions in this case, for example, in order to simplify their mounting or magnetic field coupling to the respective permanent magnet disks 12*a*, 12*b* (the configuration according to FIGS. 2, 3 may basically also be realized with non-magnetic or magnetically non-conductive retaining means, which can be suitably provided in this region in order to mount the sensor elements). Sensor elements 34*a* and 34*b* are respectively assigned to each of the permanent magnet elements 12*a*, 12*b* as shown such that the position detection of the armature unit including plunger 10 and therefore also of the engaging actuating partner 32 can insofar be carried out specific to the respective application and with a high degree of detection reliability.

In the exemplary embodiment according to FIGS. 2, 3, an energization of the stator coil would then once again lead to the armature being purposefully moved into the stop position of the permanent magnet means on the left side (FIG. 2) or the stop position of the permanent magnet means on the right side (FIG. 3)—depending on the polarity of the energization—such that the flexibility and applicability or adaptability of the detection is additionally increased in this respect and in comparison with the first exemplary embodiment according to FIG. 1. Although not illustrated in FIGS. 2, 3, it is also possible, e.g., to suitably assign a second actuating partner to the plunger 10 in an end region that lies opposite of the end face 28 (wherein this can basically also be realized in the first exemplary embodiment 1).

Figure 4:
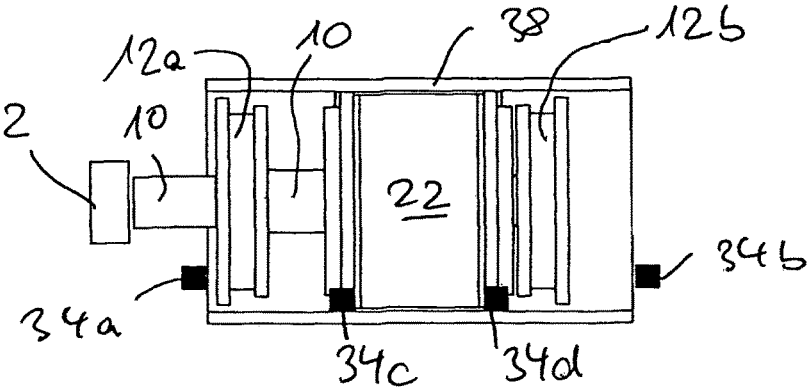
FIG. 4 shows a variation of the second exemplary embodiment according to FIGS. 2, 3, in which additional detectors of the magnetic field detector means are furthermore provided.
Figure 5:
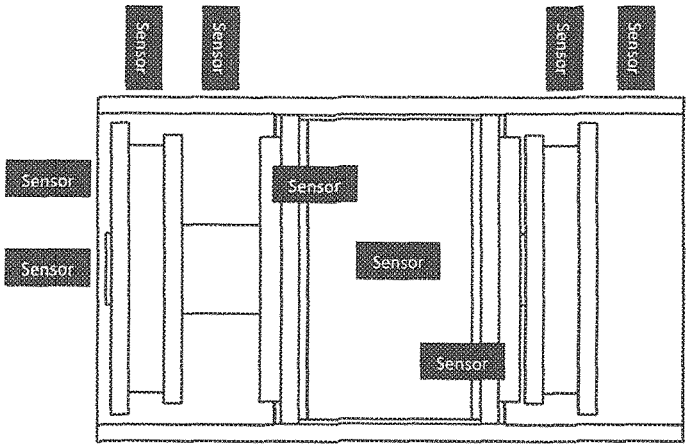
FIG. 5 shows a schematic representation with an illustration of different individual or cumulative arrangement options for individual detectors of the inventive magnetic field detector means in the exemplary embodiment according to FIGS. 2, 3.

FIGS. 4 and 5 show other options for providing the detector functionality on the mechanical design according to FIGS. 2, 3; for example, the reference symbols 34*c*, 34*d* designate other options for providing detector elements; in this respect, the exemplary embodiment according to FIG. 4 would double the detection reliability for a position detection because two detector elements would then be assigned to each stop or end position and two detector signals could accordingly be evaluated. The redundancy of such an embodiment would therefore be particularly suitable for sensitive or failure-prone applications. In contrast, FIG. 5 schematically shows basic options for the arrangement of magnetic field sensors, e.g. semiconductor-based sensors of the Hall sensor type, which are respectively identified by the designation "Sensor": it becomes clear that sensors can not only be arranged along the moving path (and also, e.g., in axial intermediate positions), but sensors in fact can also be arranged in a radially offset fashion, namely starting from a respective end face, as well as with respect to potential installation positions on or in the central stator arrangement.

Figure 6:
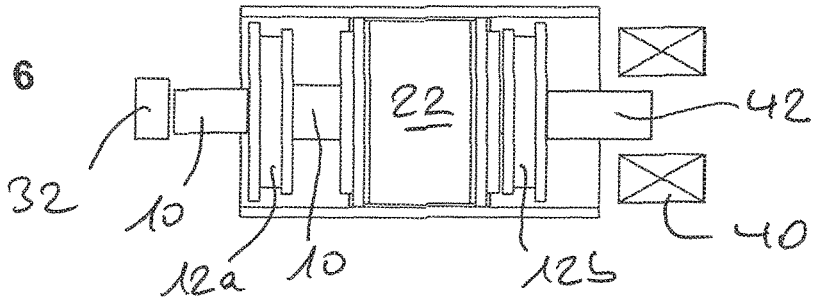
FIG. 6 shows a variation of the detection by means of terminally provided detector coils for realizing the magnetic field detector means in the exemplary embodiment according to FIGS. 2, 3.

In contrast, the exemplary embodiment according to FIG. 6, which is otherwise structurally comparable to the functionality according to FIGS. 2, 3, shows a variation of the arrangement of semiconductor-based Hall magnetic field sensors on the respective faces in the form of the terminal arrangement of a magnet coil detector 40, which generates a correspondingly variable coil signal to be further evaluated and processed in response to a change in position of the free end 42 of the plunger unit 10 (caused by the armature motion).

Figure 7:
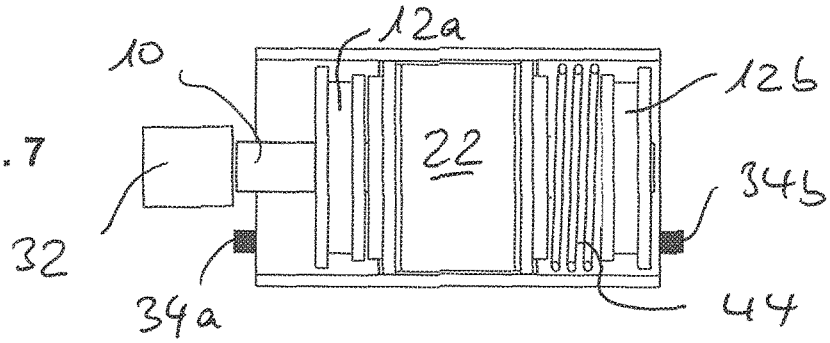
FIG. 7 shows another variation of the exemplary embodiment according to FIGS. 2, 3, in which spring means are provided opposite to an actuating direction.

The exemplary embodiment according to FIG. 7, which is otherwise structurally comparable to the exemplary embodiment according to FIGS. 2, 3, shows an example of the pressure spring 44 on the right side, which is inserted concentric to the plunger 10, and how a compressive or motive actuation of the detector unit due to a rightward force application by the actuating partner 32 encounters an opposing spring force (corresponding to the required compressive force of the pressure spring 44) and therefore provides the option of thusly or otherwise influencing the detection behavior. Such a spring solution could be particularly suitable for homogenizing a strongly vibrating force signal of the actuating partner 32 or for otherwise achieving an improved mechanical reactivity of the arrangement shown.

Figure 8:
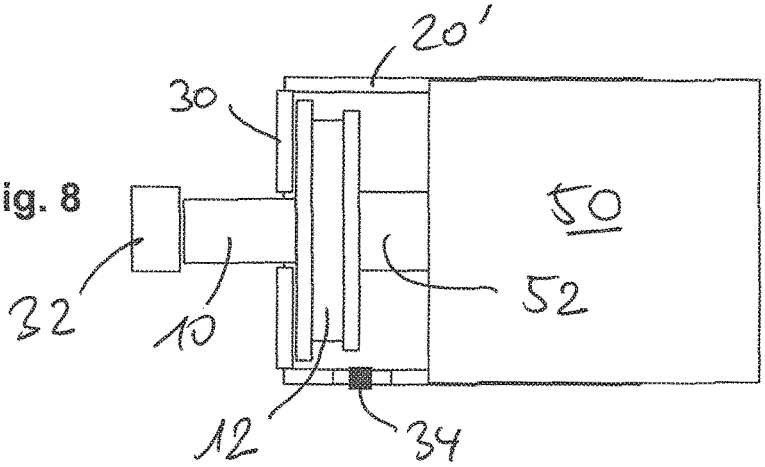
FIG. 8 shows a generalization of the inventive idea of the first embodiment in the form of a generic exemplary embodiment, in which a schematically illustrated modular, independent actuator in the form of an assembly is utilized within an actuator device according to the first exemplary embodiment illustrated in FIG. 1.

FIG. 8 shows how an actuator unit, which is terminally attached to the housing 20' in the form of a separate encapsulated plunger unit 50, realizes the electromagnetic motion of the armature unit with its plunger section 52 that can be extended from the housing, namely in the form of a potential alternative embodiment of the basic inventive principle according to FIG. 1, but alternatively also in the form of a potential variation of the exemplary embodiment according to FIGS. 2, 3 and exemplary embodiments derived thereof; in this case, the armature unit (FIG. 1) would be reduced to a significantly shortened plunger unit 10 with contacting permanent magnet body 12 (including two adjacent disks 14, 16); the actuator plunger 52, which can be extended from the end of the actuator housing 50 indicated in the form of a black box, would in this respect exert a leftward actuating force upon the armature 10, 12 (opposite to a rightward force of pressure or thrust of the actuating partner 32 to be detected). This principle, which utilizes an otherwise known actuator in the form of a complete assembly 50 for the further modularization, can be likewise applied to the exemplary embodiment according to FIGS. 2, 3, in which case an actuator plunger would have to be axially extended from both ends of this actuator in order to respectively displace one of the permanent magnet assemblies in an analogous fashion.

The invention claimed is:

1. A bistable electromagnetic actuator device, comprising:

a permanent magnet means (12; 12*a*, 12*b*), as well as an armature unit (18) with an elongate plunger unit (10) extending along a moving direction, wherein said armature unit can be moved into at least one of two end and/or stop positions that are stable in the deenergized state by means of stationary electromagnetic driving means (22), wherein stationary magnetic field detector means (34; 34*a*, 34*b*) are positioned relative to a housing (20), which at least sectionally encloses the armature unit, for contactless interaction with the permanent magnet means in at least one of the end or stop positions provided for armature position detection, wherein the plunger unit features a terminal contact and/or engagement section (28) for interacting with an actuating partner such that contact and/or actuation by the actuating partner causes a motion of the armature unit into one of the end or stop positions, in which the armature unit remains in a stable fashion in the deenergized state, when the electromagnetic driving means are deactivated, wherein the magnetic field detector means are arranged and wired for generating and outputting a detector signal corresponding to this end or stop position, wherein the driving means are realized in the form of a stationary coil unit that is provided on or in the housing and assigned a stationary core unit, which forms a stopping face (26) for a stopping section of the armature unit, and wherein the plunger unit (10) extends into and is guided in the core unit or through the core unit.

2. The device according to claim 1, wherein the permanent magnet means are realized in the form of disk-shaped permanent magnet bodies (12; 12*a*, 12*b*), which are provided on the plunger unit axially on both ends of the core and/or coil unit and designed in such a way that one of the permanent magnet bodies respectively contacts the core or coil unit while the other permanent magnet body is axially spaced apart from the core or coil unit in the two end or stop positions.

3. The device according to claim 2, wherein the magnetic field detector means are provided axially on both ends of the core or coil unit.

4. The device according to claim 1, wherein the magnetic field detector means are provided on one end of the stationary driving means, such that a plurality of positions of the armature unit can be detected by an assigned plurality of detector elements of the magnetic field detector means.

5. The device according to claim 1, wherein energy accumulator means (44) are assigned to the armature unit in order to generate a counterforce that acts opposite to the contact or actuation by the actuating partner, wherein said energy accumulator means are realized in the form of a flat coil spring and/or pressure spring arranged concentric to the plunger unit.

6. A utilization of the bistable electromagnetic actuator device according to claim 1 as a motion and/or position sensor for the actuating partner and/or for detecting a motion or change in position of the actuating partner.

7. The utilization according to claim 6, wherein a position of the armature unit actuated by the actuating partner in the deenergized state is stored.

8. A system consisting of an actuating partner to be evaluated or to be monitored for the position and/or motion detection and the device according to claim 1.

9. A bistable electromagnetic actuator device, comprising:

a permanent magnet means (12; 12*a*, 12*b*), as well as an armature unit (18) with an elongate plunger unit (10) extending along a moving direction, wherein said armature unit can be moved into at least one of two end and/or stop positions that are stable in the deenergized state by means of stationary electromagnetic driving means (22), wherein stationary magnetic field detector means (34; 34*a*, 34*b*) are positioned relative to a housing (20), which at least sectionally encloses the armature unit, for contactless interaction with the permanent magnet means in at least one of the end or stop positions provided for armature position detection, wherein the plunger unit features a terminal contact and/or engagement section (28) for interacting with an actuating partner such that contact and/or actuation by the actuating partner causes a motion of the armature unit into one of the end or stop positions, in which the armature unit remains in a stable fashion in the deenergized state, when the electromagnetic driving means are deactivated, and wherein the magnetic field detector means are arranged and wired for generating and outputting a detector signal corresponding to this end or stop position, wherein the magnetic field detector means are semiconductor-based and/or realized by means of a detector coil and provided on the magnetically conductive housing in such a way that the housing is detection-effectively permeable to the permanent magnetic field of the permanent magnet means in the end or stop positions provided for the armature position detection, wherein the housing features a housing aperture, a housing opening and/or a housing section, which at least sectionally is magnetically non-conductive for this purpose.

10. A bistable electromagnetic actuator device, comprising:

a permanent magnet means (12; 12*a*, 12*b*), as well as an armature unit (18) with an elongate plunger unit (10) extending along a moving direction, wherein said armature unit can be moved into at least one of two end and/or stop positions that are stable in the deenergized state by means of stationary electromagnetic driving means (22), wherein stationary magnetic field detector means (34; 34*a*, 34*b*) are positioned relative to a housing (20), which at least sectionally encloses the armature unit, for contactless interaction with the permanent magnet means in at least one of the end or stop positions provided for armature position detection, wherein the plunger unit features a terminal contact and/or engagement section (28) for interacting with an actuating partner such that contact and/or actuation by the actuating partner causes a motion of the armature unit into one of the end or stop positions, in which the armature unit remains in a stable fashion in the deenergized state, when the electromagnetic driving means are deactivated, and wherein the magnetic field detector means are arranged and wired for generating and outputting a detector signal corresponding to this end or stop position, wherein the contact and/or engagement section is designed for producing a mechanical contact and/or connection with the actuating partner, which can be effectively subjected to pressure and/or tension in or opposite to the moving direction.

11. The device according to claim 10, wherein the contact and/or engagement section features or forms a mechanical coupling, a thread section, a peripheral groove, an undercut and/or a probe head.

* * * * *